US006422686B1

(12) United States Patent
Ishinaga et al.

(10) Patent No.: US 6,422,686 B1
(45) Date of Patent: Jul. 23, 2002

(54) LIQUID DISCHARGE HEAD AND METHOD OF MANUFACTURING THE SAME

(75) Inventors: Hiroyuki Ishinaga, Tokyo; Masami Kasamoto, Ayase; Torachika Osada, Yamato; Shuji Koyama, Kawasaki; Haruhiko Terai; Genji Inada, both of Yokohama; Junji Tatsumi, Kawasaki; Hiroyuki Sugiyama, Sagamihara; Ken Ikegame, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/576,612

(22) Filed: May 24, 2000

(30) Foreign Application Priority Data

May 27, 1999 (JP) ..... 11-148540

(51) Int. Cl.[7] ..... B41J 2/14
(52) U.S. Cl. ..... 347/47; 347/65
(58) Field of Search ..... 347/47, 63, 65; 29/890.1

(56) References Cited

U.S. PATENT DOCUMENTS

| | | | | |
|---|---|---|---|---|
| 5,059,973 A | | 10/1991 | Watanabe | 347/56 |
| 5,604,521 A | | 2/1997 | Merkel et al. | 347/47 |
| 6,079,810 A | * | 6/2000 | Davis | 347/47 |

FOREIGN PATENT DOCUMENTS

| | | | |
|---|---|---|---|
| EP | 836906 A1 * | 4/1998 | B23K/26/06 |
| JP | 2-204048 | 8/1990 | |

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

In a liquid discharge head having an orifice plate in which a plurality of discharge ports for discharging liquid droplets therethrough are arranged, and a head body provided with a plurality of flow paths communicating with the plurality of discharge ports, a liquid chamber for supplying liquid to the plurality of flow paths, and a plurality of energy generation elements disposed correspondingly to the plurality of flow paths and generating energy for discharging the liquid droplets, the orifice plate being joined to the joined surface of the head body in which the communication ports of the flow paths communicating with the discharge ports are disposed, the orifice plate is formed with wall-shaped convex portions protruding from the inner peripheral portions of the discharge ports and having at least a portion thereof entering from the communication ports into the flow paths, and the width of the wall-shaped convex portions is greater in the portions thereof parallel to the row direction in which the plurality of discharge ports are arranged than in the portions thereof orthogonal to the row direction.

28 Claims, 11 Drawing Sheets

LIQUID DISCHARGE HEAD AND METHOD OF MANUFACTURING THE SAME

BACKGROUND OF THE INVENTION

1. Field of the Invention

This invention relates to a liquid discharge head for discharging liquid and effecting recording by flying liquid droplets. More particularly, the invention relates to a liquid discharge head applicable to an apparatus such as a facsimile apparatus having a printer, a copier and a communication system for effecting recording on a recording medium such as paper, thread, fiber, cloth, leather, metals, plastics, glass, wood or ceramics, and a word processor having a printer portion, and further an industrial recording apparatus compositely combined with various processing apparatuses, and a method of manufacturing the liquid discharging head.

"Recording" in the present invention means not only imparting images such as characters and figures having meanings to a recording medium, but also imparting images such as patterns having no meaning to the recording medium.

2. Related Background Art

An ink jet recording apparatus for discharging recording liquid (ink) from the discharge port (orifice) of a liquid discharge head to thereby effect recording is known as a recording apparatus excellent in such points is low noise and high-speed recording. As such ink jet recording apparatuses, ones of various types have heretofore been proposed and improved, and some of them have already been commercialized or are being developed for practical use.

An example of the ink jet recording apparatus according to the prior art, as shown in FIGS. 14 and 15 of the accompanying drawings, has a liquid discharge head comprised of an orifice plate 200 for discharging ink, a top plate 210 for forming a flow path 202 communicating with a discharge port 201, and a substrate 204 having an energy generation element 203 provided in the flow path 202 and generating energy for discharging liquid.

The minute discharge port 201 for liquid discharge provided in the orifice plate 200 is an important element which governs the discharging performance of the liquid discharge head. That is, the orifice plate 200 of the liquid discharge head is required to be formed of a material having good workability for forming the minute discharge port 201 and having a good ink-resisting property for the direct contact with the ink. Heretofore, as a material satisfying such conditions, use has been made of a metal plate of stainless steel, nickel, chromium, aluminum or the like, or resin film easy to obtain a desired thickness and inexpensive, such as polyimide, polysulfone, polyether sulfone, polyphenylene oxide, polyphenylene sulfide or polypropylene.

Japanese Patent Application Laid-Open No. 2-204048 discloses a liquid discharge head of a construction in which a portion of an orifice plate enters into a flow path to improve discharge efficiency. Specifically, this liquid discharge head is of a construction in which a part of the material forming the orifice plate is softened by heat and comes into the flow path, and thereafter forms a discharge port. Further, U.S. Pat. No. 5,604,521 discloses a liquid discharge head which uses an orifice plate having a convex portion formed with an orifice and provided on a joined surface with the main body of the head and in which adhesive resin is applied to the joined surface of the orifice plate, whereafter the convex portion is fitted into a flow path.

However, when the liquid discharge head has the convex portion to be fitted into the orifice, the discharge port assumes a tapered shape and therefore, when the flow path is to be highly densely arranged, the highly dense arrangement of the convex portion has been limited.

SUMMARY OF THE INVENTION

It is an object of the present invention to provide a liquid discharge head having:

an orifice plate in which a plurality of discharge ports for discharging liquid droplets therethrough are arranged in a row; and a head body provided with a plurality of flow paths communicating with the plurality of discharge ports, a liquid chamber for supplying liquid to the plurality of flow paths, and a plurality of energy generation elements disposed correspondingly to the plurality of flow paths and generating energy for discharging the liquid droplets;

the orifice plate being joined to the joined surface of the head body in which the communication ports of the flow paths communicating with the discharge ports are disposed;

characterized in that the orifice plate is formed with wall-shaped convex portions protruding from the inner peripheral portions of the discharge ports and having at least a portion thereof entering from the communication ports into the flow paths, and the width of the wall-shaped convex portions is greater in the portions thereof parallel to the row direction in which the plurality of discharge ports are arranged than in the portions thereof orthogonal to the row direction.

It is another object of the present invention to provide a liquid discharge head having:

an orifice plate in which a plurality of discharge ports for discharging liquid droplets therethrough are arranged in a row; and a head body provided with a plurality of flow paths communicating with the plurality of discharge ports, a liquid chamber for supplying liquid to the plurality of flow paths, and a plurality of energy generation elements disposed correspondingly to the plurality of flow paths and generating energy for discharging the liquid droplets;

the orifice plate being joined to the joined surface of the head body in which the communication ports of the flow paths communicating with the discharge ports are disposed;

characterized in that the orifice plate is formed with wall-shaped convex portions protruding from the inner peripheral portions of the discharge ports and having at least a portion thereof entering from the communication ports into the flow paths, and on the joined surface side of the orifice plate to the head body, as compared with the inner end portions of the discharge ports at positions orthogonal to the row direction in which the plurality of discharge ports are arranged, the wall-shaped convex portions located in parallelism to the row direction are formed high in the direction of thickness of the orifice plate.

It is still another object of the present invention to provide a method of manufacturing a liquid discharge head having:

an orifice plate in which a plurality of discharge ports for discharging liquid droplets therethrough are arranged in a row; and a head body provided with a plurality of flow paths communicating with the plurality of discharge ports, a liquid chamber for supplying liquid to the plurality of flow paths, and a plurality of energy generation elements disposed correspondingly to the plurality of flow paths and generating energy for discharging the liquid droplets;

the orifice plate being joined to the joined surface of the head body in which the communication ports-of the flow paths communicating with the discharge ports are disposed;

characterized in that the orifice plate is formed with wall-shaped convex portions protruding from the inner peripheral portions of the discharge ports and having at least a portion thereof entering from the communication ports into the flow paths, and the wall-shaped convex portions are formed by laser working after the discharge ports have been formed by laser working.

Other objects and features of the present invention will become apparent from the following detailed description taken in conjunction with the accompanying drawings.

DESCRIPTION OF THE PREFERRED EMBODIMENTS

Some embodiments of the present invention will hereinafter be described with reference to the drawings.

Figure 1:
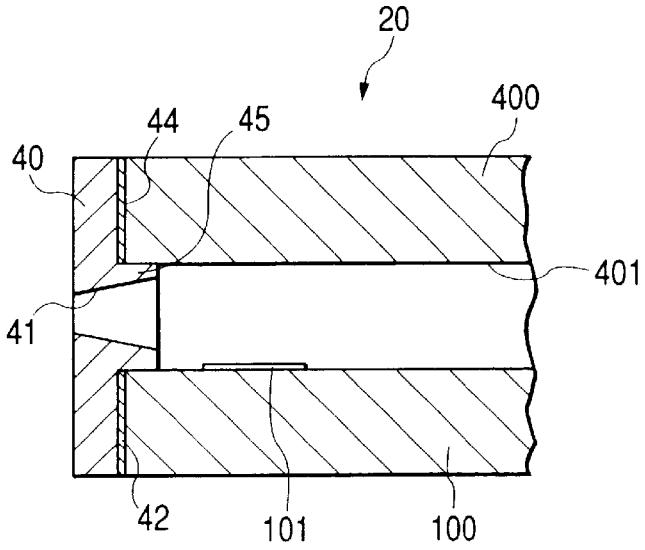
FIG. 1 is a typical cross-sectional view showing the essential portions of a liquid discharge head according to a first embodiment of the present invention.
Figure 2:
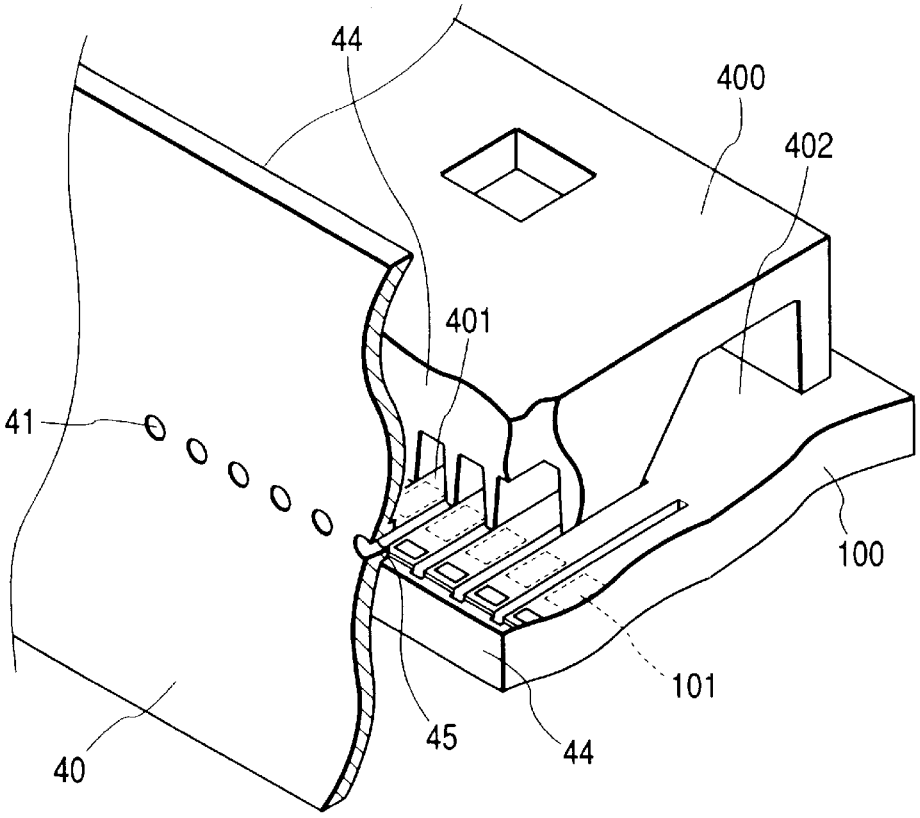
FIG. 2 is a perspective view, partly in cross-section, of the liquid discharge head shown in FIG. 1.

FIGS. 1 and 2 show a liquid discharge head according to a first embodiment of the present invention. A top plate 400 formed with a plurality of flow paths 401 and groove-shaped recesses for constituting a single liquid chamber 402 communicating with the plurality of flow paths 401, and a base plate (heater board) 100 comprising a Silicon substrate on which energy generation elements (in the present embodiment, heaters which are heat generation elements) 101 for generating discharge energy and wiring of aluminum (not shown) for supplying an electrical signal thereto are formed by the film forming technique are joined together, whereby a head body 20 is constructed. The top plate 400 and the base plate 100 are joined together, thereby the flow paths 401 and the liquid chamber 402 are constructed between the top plate 400 and the base plate 100.

An orifice plate 40 is stuck on an opening disposition surface (the joined surface of the head body 20) 44 in which the communication port (the fore end opening portion) of each flow path 401 is located, by an adhesive layer 42. The orifice plate 40 in the present embodiment comprises polysulfone film having a thickness of 50 $\mu$m. The orifice plate 40 is provided with a plurality of discharge ports 41 communicating with the respective flow paths 401, and a convex portion 45 protruding from the inner wall of each discharge port 41 to the head body 20 side is integrally formed. This convex portion 45 enters into the inside of the communication port of each flow path 401. The convex portions 45 and the discharge ports 41 are formed into a tapered shape.

Figure 3:
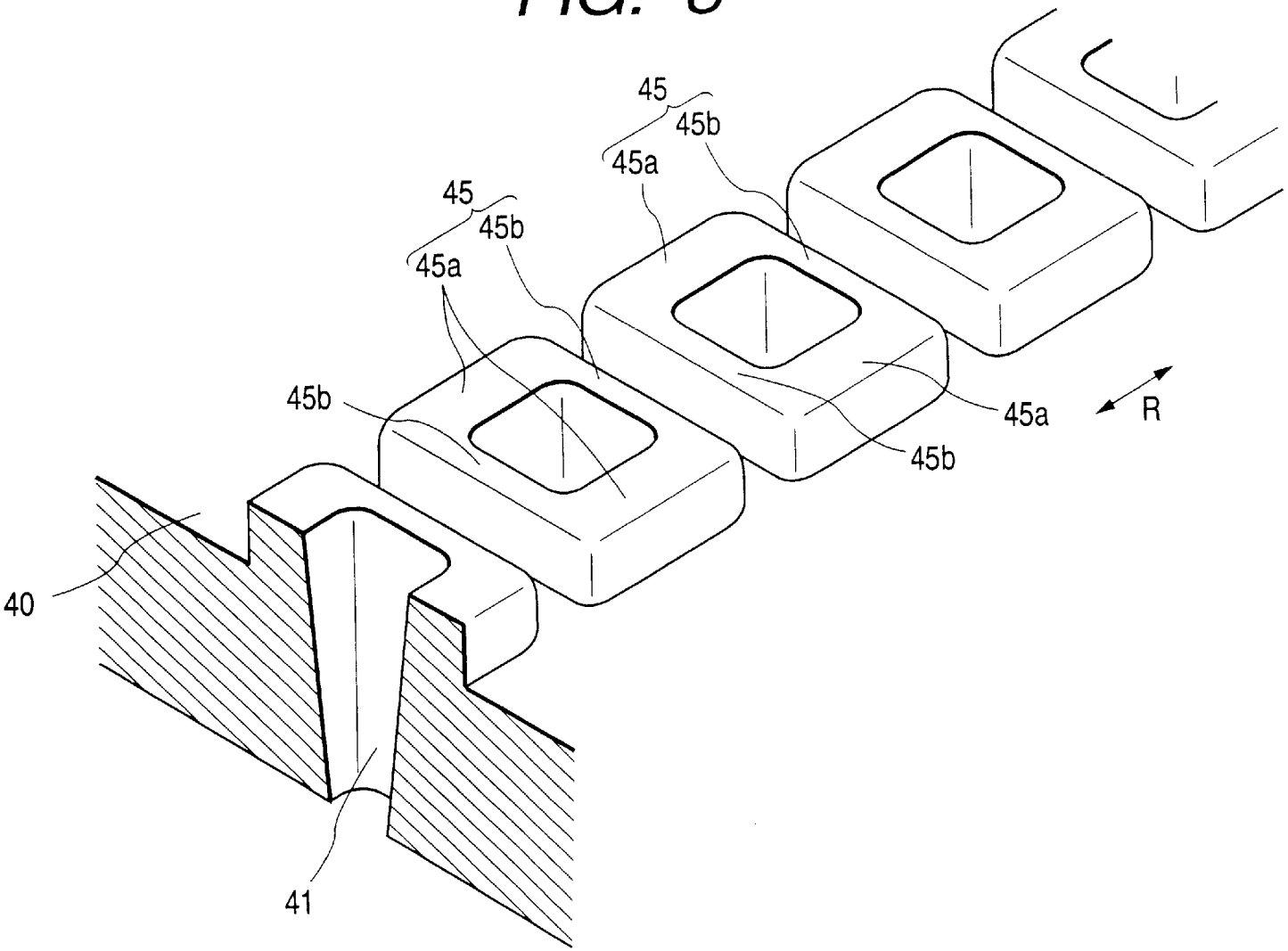
FIG. 3 is an enlarged perspective view of the back of an orifice plate shown in FIG. 1.

FIG. 3 shows an enlarged view of the convex portions in the present embodiment as they are seen from the inner surface (back) side of the orifice plate. In the present embodiment, the wall-shaped convex portion 45 is formed along the entire inner peripheral portion of each discharge port 41. This convex portion 45 is thinner in a portion 45*b* orthogonal to the row direction R in which the discharge ports are arranged than in a portion 45*a* parallel to the row direction. Thereby, the spacing between the convex portions corresponding to adjacent ones of the discharge ports 41 can be secured and therefore, the highly dense arrangement of the discharge ports 41 becomes possible. For example, the density of 600 to 720 dpi (dots per inch) at a pitch of the order of 35.5 to 42.5 $\mu$m can be adopted.

By these convex portions 45, the discharge ports 41 of the orifice plate 40 and the flow paths 401 of the head body 20 can be connected together without gaps, and the flow of ink becomes smooth and improvements in the discharge speed of the ink and the quality of print as well as in the discharge efficiency can be achieved. Also, the discharge ports 41 of the orifice plate 40 and the flow paths 401 of the head body 20 can be easily connected together with good accuracy and moreover, the strength of the joint between the orifice plate 40 and the head body 20 is heightened. The adhesive overflowing the adhesive layer 42 can be prevented from entering into the flow paths 401 to thereby change the characteristic of the flow paths.

According to this liquid discharge head, the liquid (ink) is supplied from the liquid chamber 402 to the flow paths 401. Driving means, not shown, selects a flow path 401 to discharge the ink in conformity with an image to be formed, and supplies a driving signal to a heater 101 in the selected flow path 401. The heater 101 which has received the driving signal generates heat, and heats the ink in the flow path 401. The heated ink bubbles, and ink droplets are discharged outwardly from the discharge port 41 by pressure accompanying the growth of the bubble. The ink droplets discharged outwardly adhere to a recording medium (such as recording paper), not shown, and an image is formed on the recording medium. In the present embodiment, by the convex portions 45 being formed, the flow of the ink from the flow path 401 to the discharge port 41 is smooth and discharge efficiency is good.

The material of the orifice plate 40 may desirably be metal film such as stainless steel or nickel, or plastic film excellent in ink-resisting property, for example, a resin film material such as polyimide, polysulfone, polyether sulfone, polyphenylene oxide, polyphenylene sulfide or polypropylene.

Description will now be made of a method of manufacturing the liquid discharge head of the present invention.

Two methods will first be described as methods of manufacturing the orifice plate 40.

Figure 4:
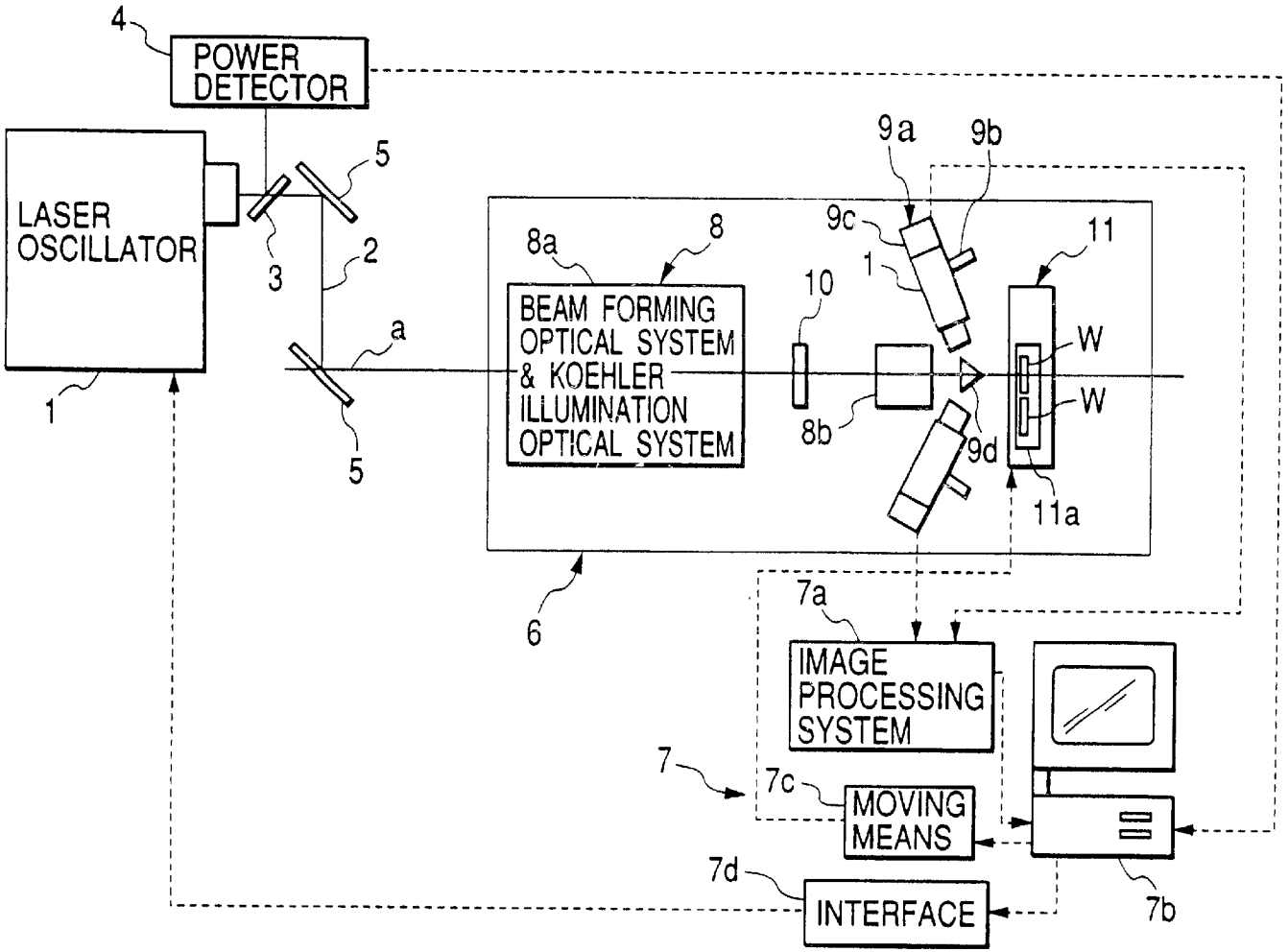
FIG. 4 schematically shows the construction of a laser working apparatus used in a first method of manufacturing the orifice plate shown in FIG. 1.

FIG. 4 schematically shows the construction of a laser working apparatus used in a first method of manufacturing the orifice plate. This laser working apparatus has a laser oscillator 1 which is a laser source emitting a laser beam 2, an apparatus frame 6 provided with a working system for effecting the working of a workpiece W by the laser beam from the laser oscillator 1, and an information processing and controlling system 7 for effecting the information processing and control regarding the working of the workpiece W.

As the laser oscillator 1 used in the laser working apparatus, one of a high output such as a YAG laser oscillator, a $CO_2$ laser oscillator, an excimer laser oscillator or an $N_2$ laser oscillator would occur to mind, and in the present embodiment, use is made of a Kr—F excimer laser oscillator of excimer laser oscillators.

The apparatus frame 6 has an optical system 8, an observation and measuring system 9 for observing and measuring the position of the workpiece W, a mask 10 and a work station 11 for moving the workpiece W. The optical system 8 has a beam forming optical system and Koehler illumination system 8*a* disposed on the optical axis a of the laser beam 2 entering the apparatus frame 6, and a projection optical system 8*b* for forming the image of the mask 10 on the worked surface of the workpiece W, and the mask 10 is disposed between the beam forming optical system and Koehler illumination system 8*a* and the projection optical system 8*b*.

Figure 5:
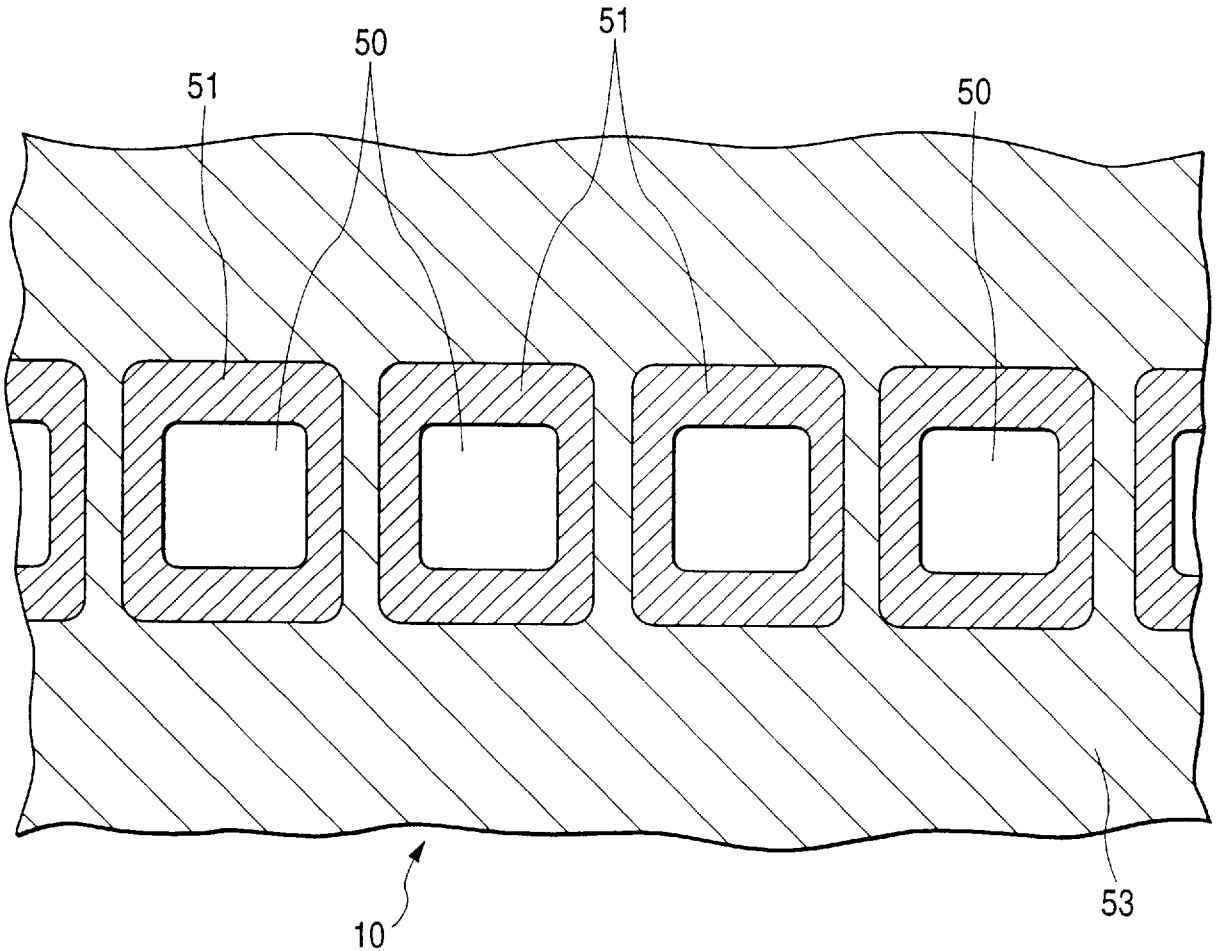
FIG. 5 is a fragmentary enlarged view of a mask used in the manufacture of the orifice plate by the laser working apparatus shown in FIG. 4.

FIG. 5 shows the mask 10 on an enlarged scale. The mask 10 in the present embodiment is partly changed in the laser beam transmittance per working unit area in order to work the orifice plate 40 of the liquid discharge head of the aforedescribed construction, and the transmittance of areas (discharge port forming portions) 50 corresponding to the discharge ports 41 shown in FIG. 1 is 100%, the transmittance of areas (convex portion forming portions) 51 corresponding to the convex portions 45 is 0%, and the transmittance of the other portion 53 is 30%.

The projection optical system 8*b* should preferably be a reduction optical system when the durability of the mask 10 is taken into account. In the present embodiment, a projection optical system 8*b* of a reduction of ¼ times is provided.

Although the detailed construction of the work station 11 is not shown, the work station 11 may preferably be provided with suitable adjusting means to adjust the inclination of the workpiece W with respect to the optical axis a. For example, the work station 11 may be constituted by a combination of three shafts orthogonal to one another and a stage having a degree of freedom with respect to the five axes of rotation about two axes. By adopting a construction in which the center for the adjustment of rotation is made coincident with the center of working of the workpiece W, the control of the adjusting means can be simplified.

A plurality of reference pins to be rammed against the workpiece W disposed on the work station 11 may preferably be provided on a jig 11*a* for mounting the workpiece W on the work station 11 for the positioning of the workpiece W on the work station 11. Also, besides the above-described ramming mechanism, a clamp mechanism using air suction or the like may preferably be provided on the jig 11*a* and be made integral with an auto-hand to thereby make the automatic supply of the workpiece W to the work station 11 possible. Further, a plurality of workpieces W may be set on the work station 11 at a time to thereby shorten the reserve time. In this case, however, an axis in the direction of rotation of the adjusting means cannot be disposed at the center of the workpieces W and therefore, it is necessary to effect the conversion of a reference value during measurement and during the movement of the workpieces W.

The observation and measuring system 9 is comprised of a pair of observation devices and a two-surface mirror 9*d* disposed on the optical axis a. Each of the observation devices comprises a lens barrel 9*a* provided with an objective lens, an epi illumination light source 9*b* incorporated in the lens barrel 9*a*, and a CCD camera sensor 9*c* connected to the lens barrel 9*a*.

Each observation device and the mirror 9*d* are disposed between the projection optical system 8*b* and the work station 11, and design is made such that the mirror 9*d* is off the optical axis a during the application of the laser, and is moved on the optical axis a only during measurement. In the present embodiment, the movement of the mirror 9*d* is controlled by an air cylinder mechanism, not shown.

The position data of the workpiece W from the observation and measuring system 9 and the data of beam power from a power detector 4 are fed back to the information processing and controlling system 7. Specifically, the information processing and controlling system 7 has an image processing system 7*a* connected to each observation device, a control system 7*b* connected to the image processing system 7*a*, moving means 7*c* connected to the control system 7*b* for effecting the movement of the workpiece W on the work station 11, and an interface 7*d* connected to the control system 7*b* and the laser oscillator 1.

Polysulfone film which provides the orifice plate 40 is set as the workpiece W shown in FIG. 4 in the work station 11. The laser beam 2 is applied from the laser oscillator 1. A part of the laser beam 2 emitted from the laser oscillator 1 is reflected by a beam splitter 3, and the reflected light is monitored by the power detector 4. On the other hand, a part of the laser beam 2 transmitted through the beam splitter 3 is reflected by two 45° total reflection mirrors 5 and enters the apparatus frame 6. The beam splitter 3 is a plane parallel plate of synthetic quartz and separates a part of the laser beam 2 by only surface reflection.

The laser beam 2 which has entered the apparatus frame 6 is transmitted through the beam forming optical system and Koehler illumination optical system 8*a*, and causes the image of the mask 10 to be formed on the worked surface of the workpiece W by the projection optical system 8*b*.

In the present embodiment, the application of the laser was effected under the condition of about 1 ($J/cm^2 \cdot puls$) and 200 to 400 puls, and the cutting of the polysulfone film by laser ablation was effected. As previously described, the mask 10 has its laser beam transmittance divided into 100%, 30% and 0% and therefore is worked in conformity with these transmittances. A cross-sectional view of the orifice plate 40 is shown in FIG. 1. That is, the portion of the transmittance 100% provides the discharge port extending completely through the polysulfone film, and the portion of the transmittance 30% is made thin to a certain degree (in the present embodiment, film having a thickness of about 50 μm is cut by the order of 10 to 20 μm into a thickness of 30 to 40 μm). The portion of the transmittance 0% is not cut, but provides a relative convex portion 45.

On the other hand, when a part of the laser beam 2 applied from the laser oscillator 1 is reflected by the beam splitter 3 and enters the power detector 4, the data of beam power is delivered from the power detector 4 to the image processing system 7*a* of the information processing and controlling system 7. The result of the processing by the image processing system 7*a* is then sent to the control system 7*b*. Also, the position data of the workpiece W is fed back from the CCD camera sensor 9*c* of the observation and measuring system 9 to the control system 7*b* of the information processing and controlling system 7.

The control system 7*b* calculates the movement distance of the workpiece W on the basis of the supplied data or the like, operates the moving means 7*c* and effects the movement of the stage on which the workpiece W is placed in the work station 11. When the position data measured by the observation and measuring system 9 assumes a predetermined value, the position adjustment by the moving means 7*c* is terminated, and the mirror 9*d* is deviated from the optical axis a, and a signal for effecting the emission of the laser beam 2 is supplied to the laser oscillator 1 for a predetermined time or by a predetermined pulse number. Also, the beam power information from the power detector 4 is fed back to the control system 7*b*, where the adjustment of the magnitude of the output given to the laser oscillator 1 through the interface 7*d* is effected. The cutting of the polysulfone film by the laser ablation is effected as described above while such control is effected, to thereby form the discharge ports 41, the convex portions 45 and the other portion. Thus, the manufacture of the orifice plate 40 is completed.

While in the above-described embodiment, there is shown a construction in which the discharge ports and the convex portions are worked at a time by laser working, it is also possible to work the discharge ports and the convex portions by discrete steps. In this case, after the discharge ports are laser-worked, the shape of the convex portions is laser-worked, whereby the working of the discharge ports can be accomplished irrespective of the shape of the convex portions and therefore, it desirably becomes possible to secure a large diameter for the discharge ports.

Figure 6:
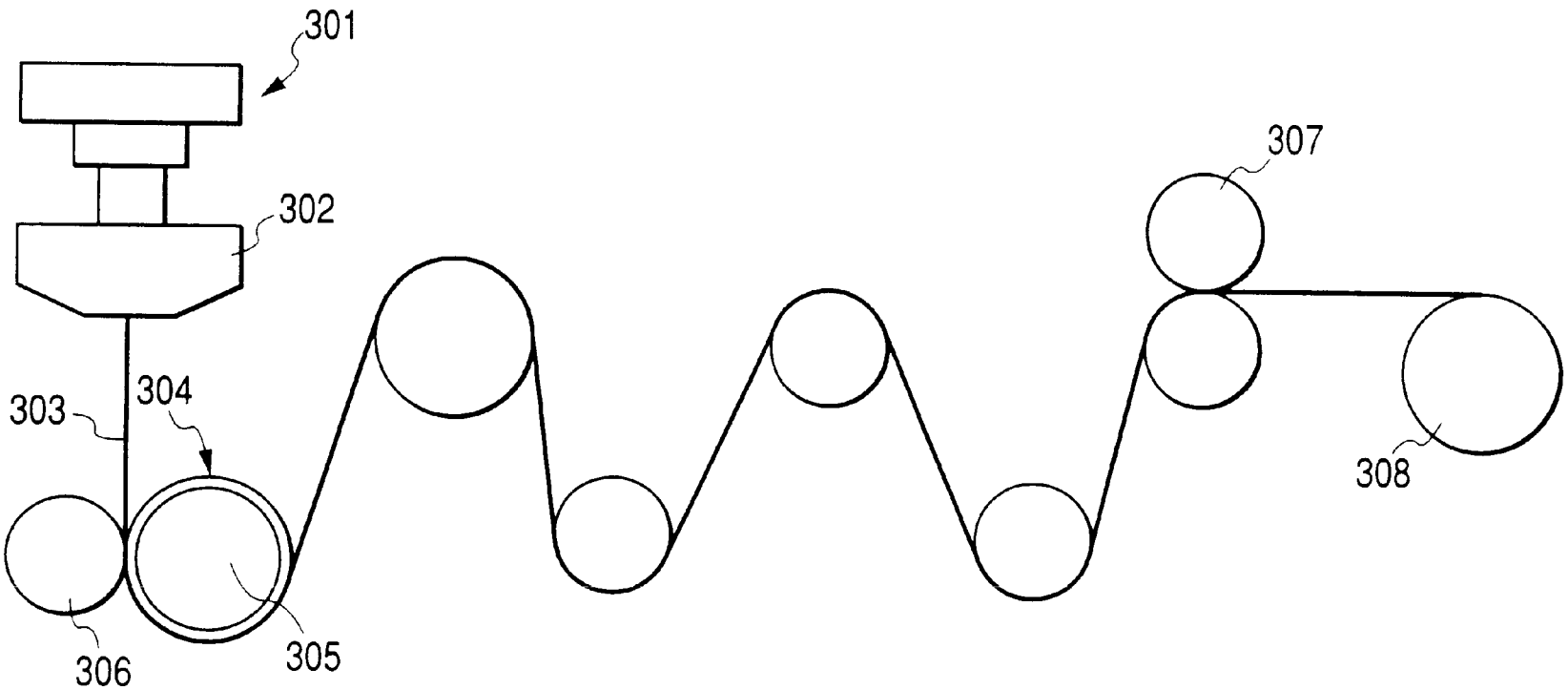
FIG. 6 schematically shows the construction of a manufacturing line used in a second method of manufacturing the orifice plate shown in FIG. 1.

FIG. 6 typically shows a portion of a manufacturing line used in a second method of manufacturing the orifice plate. In this manufacturing line, the steps of extruding molten resin into the form of film by extrusion molding, and pressing a roll provided with a relief mold of a predetermined shape against the surface of the extruded film-like resin to thereby form a pattern of a desired shape on the surface of the film-like resin are carried out.

As shown in FIG. 6, molten resin is extruded into the form of film from the die 302 of an extrusion molding machine 301, whereby film-like resin 303 is formed, and the film-like resin 303 is nipped between a cooling roll 305 and a nip roll 306 and is pressed by those rolls. A relief mold 304 of a shape conforming to the discharge ports 41 and the convex portions 45 shown in FIGS. 1 to 3 is attached to the surface of the cooling roll 305. A desired shape is continuously formed on the surface of the film-like resin 303 by this relief mold 304.

The film-like resin 303 on the surface of which the desired shape has been formed by the relief mold 304 and which has been cooled by the cooling roll 305 passes several rolls and two take-over rolls 307, and thereafter is taken up into the form of a roll by a take-up roll 308.

In this example of the method of manufacturing the orifice plate, polysulfone resin (Udel P3900 produced by Amoco Inc.) was used as the resin material extruded from the extrusion molding machine 301. It is preferable that a thermoplastic polymer be used as the resin material extruded from the extrusion molding machine 301, i.e., the material of the film-like resin 303. Also, specifically, it is preferable that one of polysulfone, polyether sulfone, polyphenylene sulfide and polyether ether ketone be used as the material of the film-like resin 303.

A method of making the orifice plate 40 will now be described.

Polysulfone resin is first extruded from the die 302 under the following working conditions so as to assume a thickness of 50 μm to thereby form film-like resin 303. The film-like resin 303 is pressed by the cooling roll 305 of a temperature of 15° C. having the relief mold 304 provided on the surface thereof and the nip roll 306 to thereby cool the film-like resin 303.

Extrusion Working Conditions

Die opening: 0.5 mm

Set temperature of the extruder: rear portion 315° C., intermediate portion 360° C., head and die portion 370° C.

Temperature of the cooling roll: 15° C.

Extrusion thickness: 50 μm

Nip pressure (air gauge pressure): 2 kgf/cm$^2$

The relief mold 304 of the cooling roll 305 is pressed against the surface of the film-like resin 303, and by this relief mold 304, a plurality of discharge ports 41 and convex portions 45 as shown in FIG. 3 are continuously formed at a time in and on the film-like resin 303 in the extrusion direction of the film-like resin 303.

After the discharge ports 41 and the convex portions 45 have been formed in and on the film-like resin 303 by the relief mold 304, a water repellent layer is formed on that surface (face surface) of the film-like resin 303 which is opposite to the convex portions 45. As a water repellent treating agent, use was made of CTx-CZ5A produced by Asahi Glass Co., Ltd. When a water repellent layer is to be formed on the face surface of the film-like resin 303, the face surface is first made hydrophilic by corona treatment, whereafter a water repellent agent is applied to the face surface of the film-like resin 303 by the use of a microgravure coater produced by Yasui Seiki Co., Ltd. as an applying apparatus. Here, the step of applying the water repellent agent and the step of prebaking the applied water repellent agent at 80° C. so that the final thickness of the water repellent layer might be 0.1 μm were continuously carried out. The film-like resin 303 taken up into the form of a roll after such applying and prebaking steps have been completed is heated at a temperature of 150° C. for 5 hours in a heating furnace, whereby a water repellent layer is formed on the face surface of the film-like resin 303.

While in the method of manufacturing the liquid discharge head according to the present embodiment, the step of pressing the relief mold 304 against the film-like resin 303 and the step of forming the water repellent layer on the film-like resin 303 have been discretely carried out, those two steps may be carried out at a single step. For example, at the step of pressing the relief mold 304 against the film-like resin 303, the pressing work against the film-like resin 303 may be done while the water repellent agent is supplied to that surface of the film-like resin 303 which is adjacent to the nip roll 306 to thereby form a water repellent layer on that surface. Alternatively, a coating roll for applying the water repellent agent may be set at a location before the film-like resin 303 is taken up by the take-up roll 308, and the water repellent agent may be applied to the film-like resin 303 by the use of the coating roll.

The film-like resin 303 in and on which the discharge ports 41 and the convex portions 45 have been formed in this manner and which has been wound into the form of a roll is cut into a necessary size for each liquid discharge head, whereby the orifice plate 40 shown in FIG. 3 is made.

Description will now be made of a method of manufacturing the liquid discharge head after the orifice plate 40 has been made.

The orifice plate 40 is made by one of the aforedescribed methods, while on the other hand, the top plate 400 and the base plate 100 are formed separately, and these are adhesively secured to each other in their layered state to thereby constitute the head body 20. In order to uniformize the opening forming surface (joined surface) 44 of the head body 20, it is preferable to cut the top plate 400 and the base plate 100 perpendicularly to the surfaces of the plates after they have been layered and secured to each other, and form the communication ports of the flow paths 401 in this cut surface to thereby provide the opening forming surface 44.

The orifice plate 40 is secured to this opening forming surface (joined surface) 44 of the head body 20 by an epoxy adhesive layer 42. At this time, each discharge port 41 communicates with each flow path 401, and the convex portions 45 are aligned so as to come into the respective flow paths 401.

As the adhesive used here, use is made of an epoxy adhesive which can be made into 13 stage (medium hardened state) while keeping tackiness (viscosity) by UV (ultraviolet rays) being applied to the adhesive, and can adhesively secure members to each other by heating and pressing or further application of UV to the adhesive after the adhesive has been hardened and constricted. Such an adhesive can also secure members to each other by only heating and pressing without being made into B stage.

Specifically, the epoxy adhesive as described above is transferred to the joined surface of the head body 20 by the transferring method. Next, ultraviolet rays of 1 $mW/cm^2$ are applied to the transferred adhesive for 60 seconds to make the adhesive into B stage, and the hardening and constriction of the adhesive are terminated while the tackiness of the adhesive is kept.

Next, the convex portions 45 of the orifice plate 40 are brought into the corresponding flow paths 401, and the convex portions 45 are fitted into the fore end opening portions (communication ports) of the flow paths 401. The fitting between the convex portions 45 and the flow paths 401 is clearance fit. Thus, a load of 1 $kg/cm^2$ is applied to the orifice plate 40 from that surface of the orifice plate 40 positioned relative to the head body 20 which is opposite to the convex portions 45 to thereby bring the orifice plate 40 and the head body 20 into close contact with each other, and while keeping that state, the orifice plate 40 is heated at a temperature of 60° C. and pressed against the head body 20, and the hardening of the adhesive is terminated.

The liquid discharge head shown in FIGS. 1 and 2 is manufactured by way of the above-described steps.

According to the aforedescribed method of manufacturing the liquid discharge head, an orifice plate 40 is not made by being divided, but is made as an integral one and therefore, even when an orifice 40 having a number of discharge ports 41 is to be made, there is no seam and the dimensional accuracy of the discharge ports 41, the convex portions 45, etc. become good. Thereby, the disadvantage that the convex portions 45 of the orifice plate 40 cannot be fitted into the flow paths 401 of the head body 20 is eliminated. Also, in the evaluation when recording was effected by the use of the manufactured liquid discharge head, there were not disadvantages such as the twist of flying liquid droplets and the irregularity of recorded images caused by the badness of the seam portions of the orifice plate 40 when the orifice plate 40 was made by being divided, and good recording dignity was obtained.

Also, the working time for manufacturing a liquid discharge head of good liquid discharge efficiency can be shortened and improved productivity can be achieved. Very highly accurate alignment becomes unnecessary during working and therefore, manufacture becomes easy and moreover, the simplification of the manufacturing apparatus becomes possible.

Further, in the aforedescribed second method of manufacturing the orifice plate, a laser is not used to form the discharge ports 41 and the convex portions 45 and therefore, there is no production of a byproduct such as carbon and thus, the labor of post-treatment is not required and a large-scale laser working machine is unnecessary, and the cost of an apparatus for manufacturing the liquid discharge head can be made low.

A second embodiment of the present invention will now be described with reference to FIG. 7. This embodiment is of a construction in which the height of the wall-shaped convex portions of the orifice plate is changed, and in the other points, the construction of the present embodiment is substantially the same as that of the first embodiment. Portions similar in construction to those of the first embodiment are given the same reference characters and need not be described.

Figure 7:
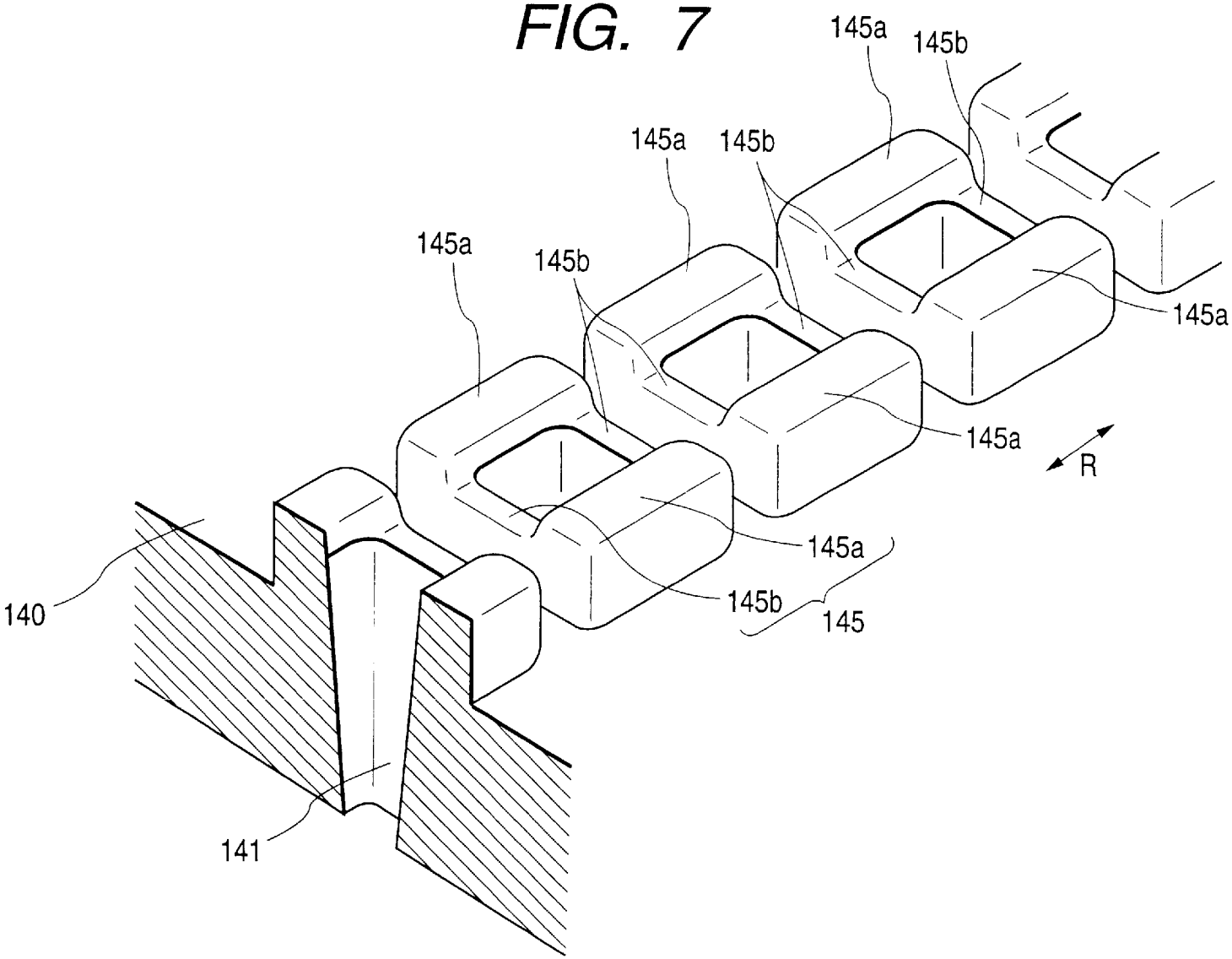
FIG. 7 is an enlarged perspective view of the back of an orifice plate according to a second embodiment of the present invention.

FIG. 7 shows an enlarged view of convex portions 145 in the present embodiment as they are seen from the inner surface (back) side of an orifice plate 140. In the present embodiment, the wall-shaped convex portions 145 are formed along the entire inner peripheral portions of discharge ports 141. These convex portions 145 are lower in portions **145*b* orthogonal to the row direction R in which the discharge ports 141 are arranged than in portions 145*a* parallel to the row direction R and therefore, the thickness of the walls is small and highly dense arrangement can be coped with. The adhesive applied to the narrow portion between adjacent ones of the discharge ports 141 is small in quantity and therefore, even the relatively low wall-shaped convex portions 145*b* can interrupt any overflowing adhesive. In contrast, a large quantity of adhesive is applied to the portion of wide area outside the row formed by the plurality of discharge ports 141 and therefore, a large quantity of adhesive may overflow. In the present embodiment, relatively tall wall-shaped convex portions 145*a* are formed to interrupt the overflowing adhesive and therefore, excellent manufacturing stability and reliability are obtained for the quantity of overflowing adhesive. In the present embodiment, the height of the portions 145*b* of the wall-shaped convex portions 145 for interrupting the adhesive overflowing from the narrow portion between adjacent ones of the discharge ports 141 which are orthogonal to the row direction is small, and the height of the portions 145***a* of the wall-shaped convex portions 145 for interrupting the adhesive overflowing from the portion of wide area outside the row formed by the discharge ports 141 which are parallel to the row direction is great. The heights of the portions 145*b* of the wall-shaped convex portions 145 which are orthogonal to the row direction and the portions 145*a* of the wall-shaped convex portions 145 which are parallel to the row direction are thus suitably set in conformity with the quantity and kind (characteristic) of the applied adhesive, whereby the convex portions 145 of necessary minimum height can be formed and this is good in efficiency.

A third embodiment of the present invention will now be described with reference to FIG. 8. Portions similar in construction to those of the first and second embodiments are given the same reference characters and need not be described.

Figure 8:
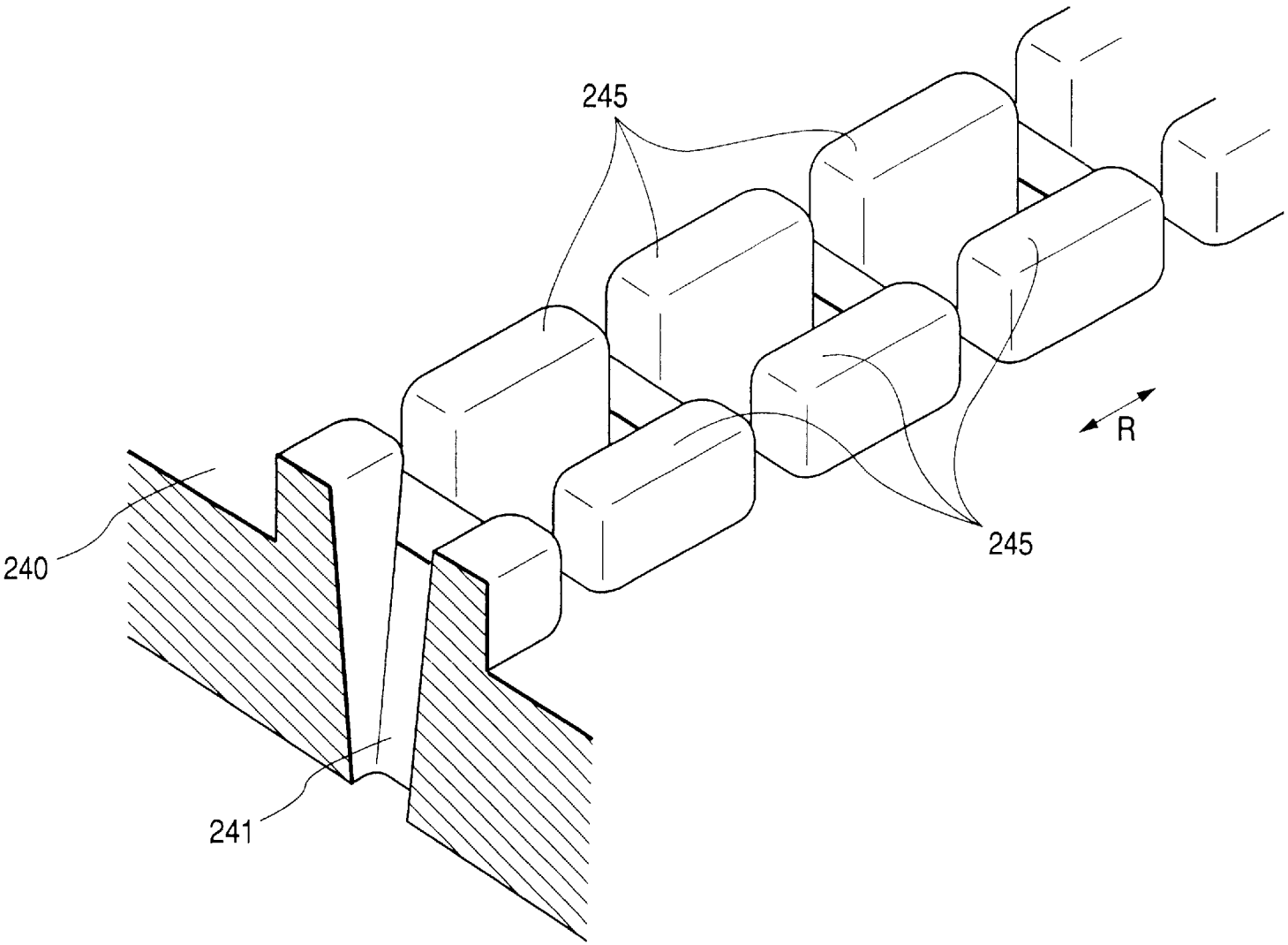
FIG. 8 is an enlarged perspective view of the back of an orifice plate according to a third embodiment of the present invention.

FIG. 8 shows an enlarged view of convex portions 245 in the present embodiment as they are seen from the inner surface (back) side of an orifice plate 240. In the present embodiment, the wall-shaped convex portions 245 are provided not along the entire inner peripheral portions of discharge ports 241, but only in portions parallel to the row direction R in which the discharge ports 241 are arranged, and are not provided in portions orthogonal to the row direction R. This is a construction in which the adhesive applied to the narrow portion between adjacent ones of the discharge ports 241 is regarded as hardly coming into the flow paths and only the adhesive overflowing from the portion of wide area outside the row formed by the discharge ports 241 is interrupted. According to this, the discharge ports 241 can be made more highly dense. For example, the density can be of the order of 1200 dpi at a pitch of 21.25 $\mu$m.

Figure 9B:
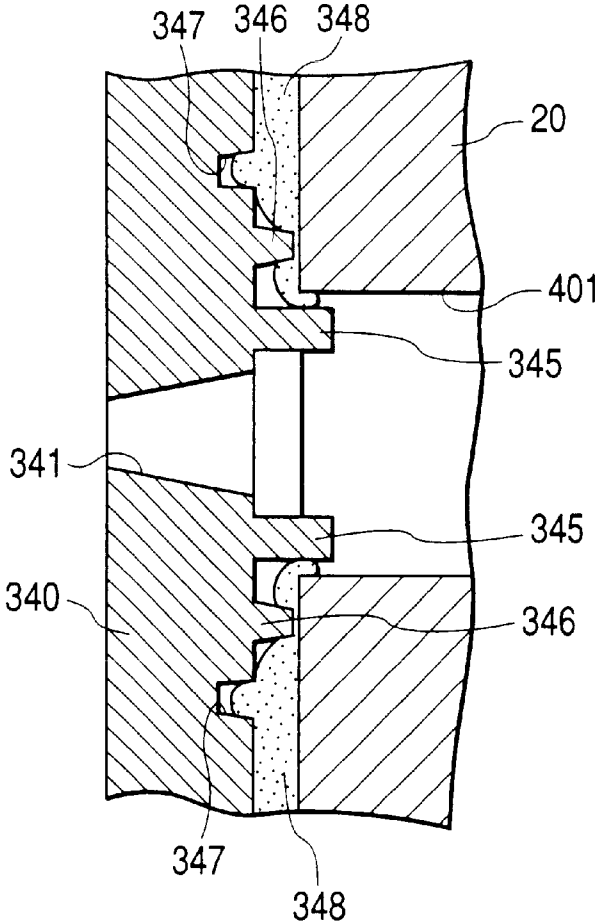
FIG. 9B is a cross-sectional view of the essential portions of the liquid discharge head thereof.
Figure 9A:
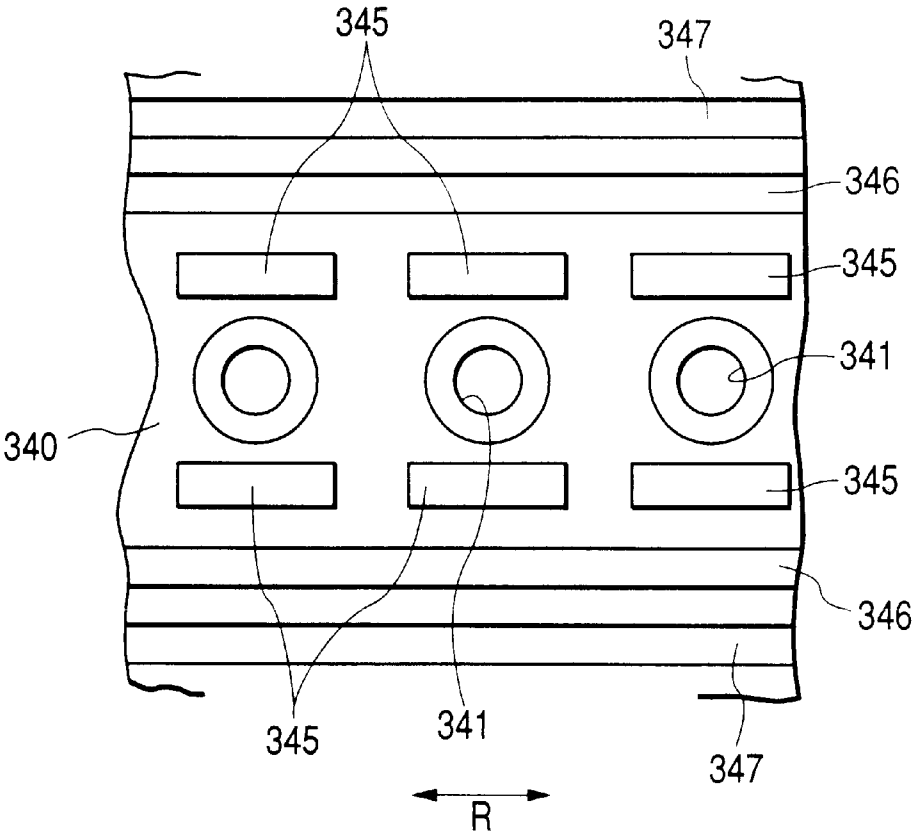
FIG. 9A is an enlarged rear view of an orifice plate according to a fourth embodiment of the present invention.

In a fourth embodiment shown in FIGS. 9A and 9B, in addition to the construction of the third embodiment, interruption wall portions 346 parallel to the row direction in which discharge ports 341 are arranged are formed outside the portions of wall-shaped convex portions 345 which are also parallel to the row direction. The interruption wall portions 346, unlike the wall-shaped convex portions 345, are provided not at locations entering into the communication ports of flow paths 401, but at locations whereat they abut against the opening forming surface (joined surface) 44 of the head body 20 during joint. Further outside these interruption wall portions 346, there are provided groove portions 347 also parallel to the row direction.

According to the present embodiment, design is made such that at a location separate from the flow paths, the inflow of an adhesive 348 is interrupted by the interruption wall portions 346 and further, the overflowing adhesive 348 is contained in the groove portions 347 and therefore, the inflow of the adhesive 348 into the flow paths 401 can be prevented more reliably. Also, the area of application of the adhesive in the orifice plate 340 is large due to the unevenness of the groove portion 347 and the interruption wall portions 346 and therefore, the strength of the joint between the orifice plate 340 and the head body 20 by the adhesive is improved.

Figure 10:
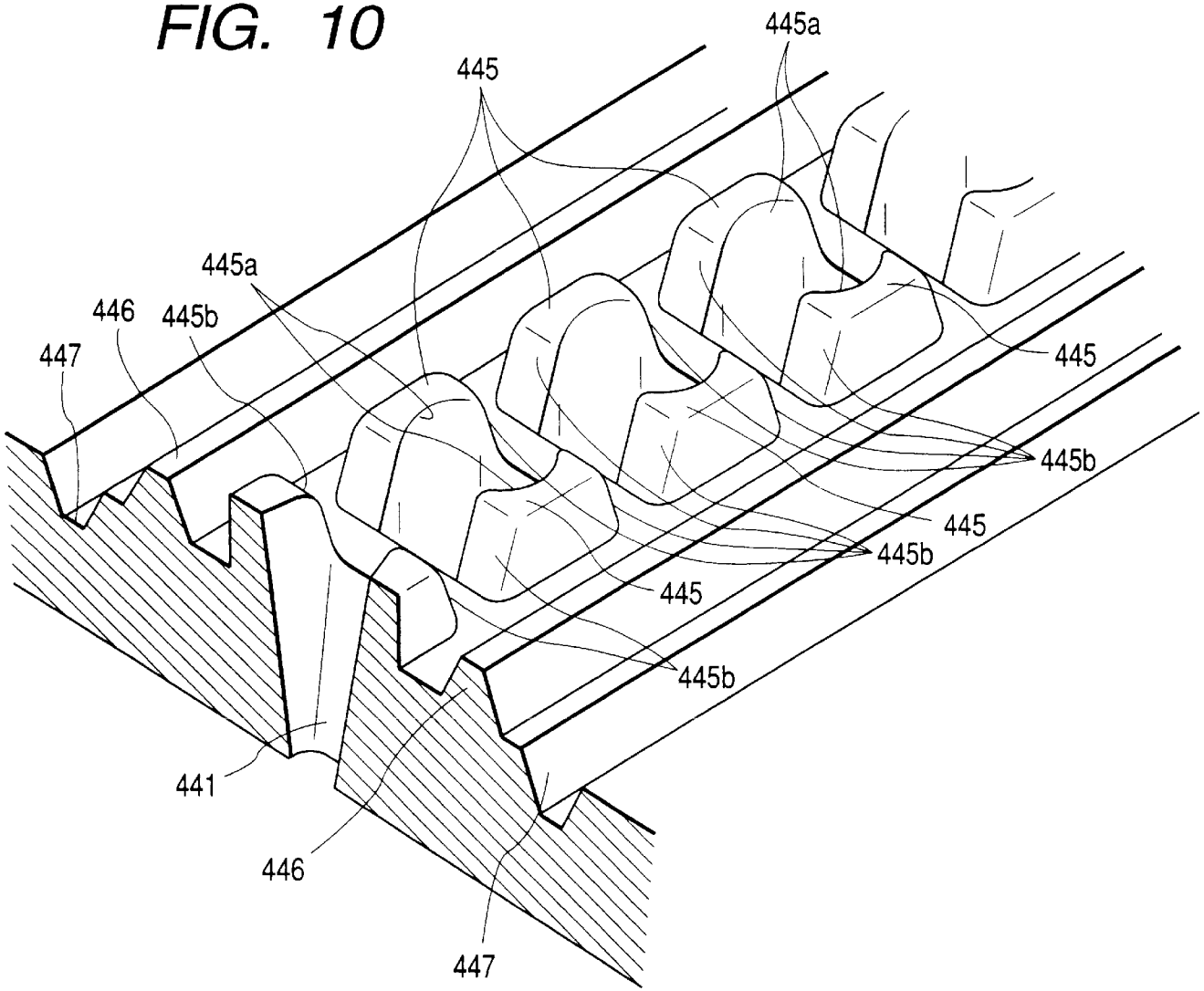
FIG. 10 is an enlarged perspective view of the back of an orifice plate according to a fifth embodiment of the present invention.

In a fifth embodiment of the present invention shown in FIG. 10, the shape of wall-shaped convex portions 445 differs from that in the fourth embodiment. That is, the wall-shaped convex portions 445 are provided only in portions parallel to the row direction in which discharge ports 441 are arranged, and the inner sides of these convex portions 445 (the surfaces facing the discharge port 441 side) are curved surfaces 445*a* similar to the discharge ports 441. Thereby, the directional stability of ink discharge is heightened. Further, in the present embodiment, the wall-shaped convex portions 445 have their opposite end portions 445*b* formed into a tapered shape so as to be lengthwisely tapered. Thereby, the work of bringing the convex portions 445 into the communication ports of flow paths 401 can be done easily.

As in the fourth embodiment, there are provided interruption wall portions 446 and groove portions 447 parallel to the row direction in which the discharge ports 441 are arranged. Thereby, the entry into the adhesive into the flow paths 401 can be prevented and also, the strength of the joint between the orifice plate 440 and the head body 20 can be improved. However, one or both of the interruption wall portion 446 and the groove portion 447 can be omitted.

Figure 11A:
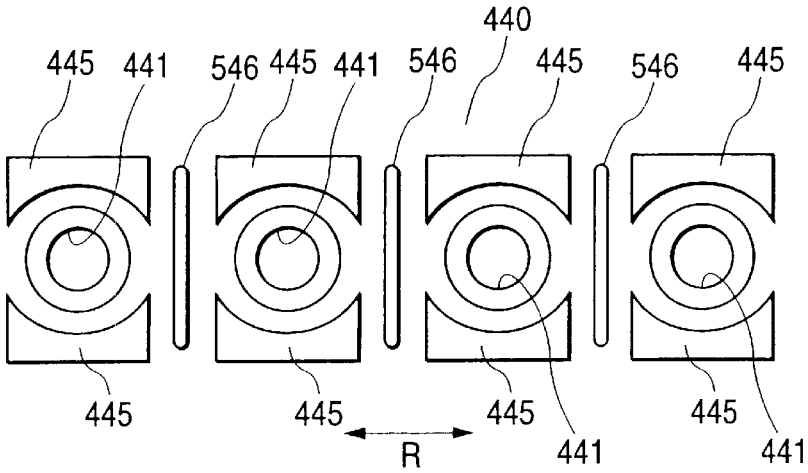
FIG. 11A is an enlarged rear view of an orifice plate according to a sixth embodiment of the present invention.
Figure 11B:
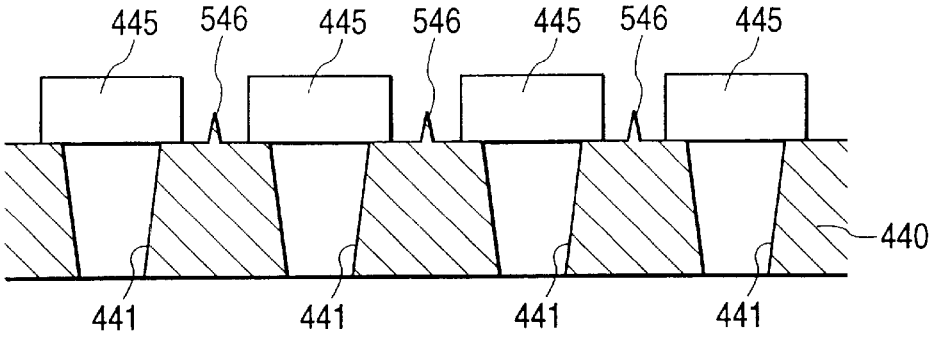
FIG. 11B is a cross-sectional view thereof.

Description will now be made of a sixth embodiment shown in FIGS. 11A and 11B. In this embodiment, there are provided wall-shaped convex portions 445 similar to those in the fifth embodiment and further, interruption wall portions 546, instead of wall-shaped convex portions, are provided between adjacent ones of discharge ports 441. The interruption wall portions 546, unlike the wall-shaped convex portions, are provided not at locations entering into the communication ports of flow paths 401, but at locations whereat they abut-against the joined surface 44 of the head body 20 during joint, and these interruption wall portions 546 are collapsed by the joint between the orifice plate 440 and the head body 20. By this construction, the flow path separability between nozzles is heightened, the fluid interference between the nozzles is decreased and the stability of discharge becomes high. According to the present embodiment, the inflow of the adhesive is interrupted by the interruption wall portions 546 at locations separate from the flow paths 401 and therefore, the entry of the adhesive into the flow paths 401 can be prevented more reliably than in the construction wherein the wall-shaped convex portions entering into the flow paths 401 are provided.

Figure 12:
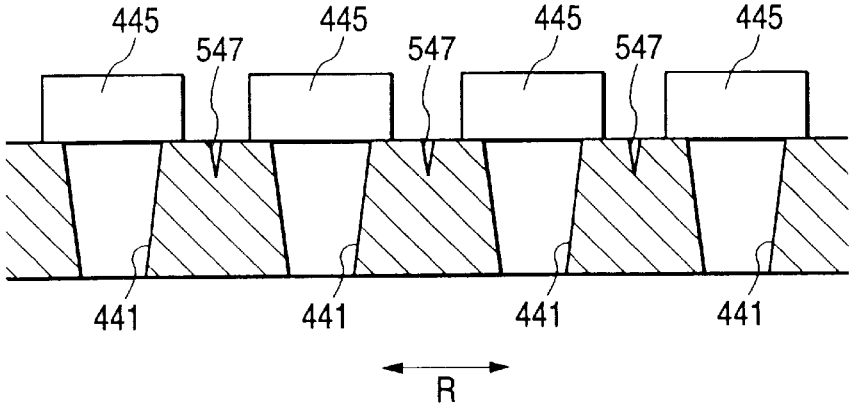
FIG. 12 is a cross-sectional view of the essential portions of an orifice plate according to a seventh embodiment of the present invention.

In a seventh embodiment shown in FIG. 12, instead of the interruption wall portions in the sixth embodiment, a groove portion 547 orthogonal to the row direction of the discharge ports 441 is formed between adjacent ones of the discharge ports 441. In the present embodiment, the overflowing adhesive is contained in the groove portions 547 to thereby prevent the inflow of the adhesive into the flow paths 401.

Figure 13:
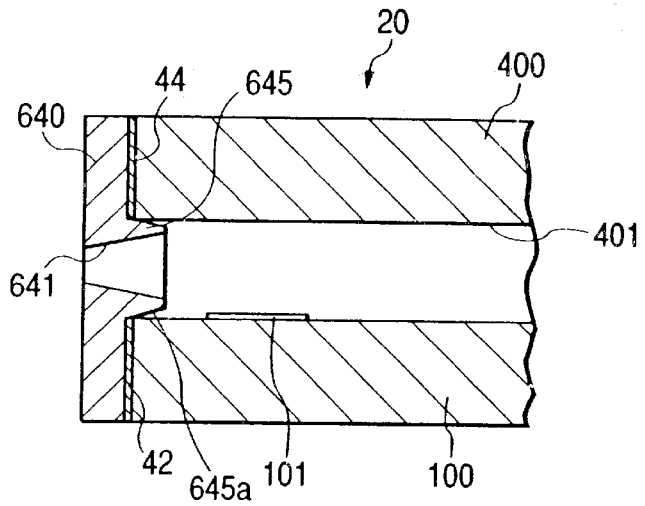
FIG. 13 is a cross-sectional view of the essential portions of a liquid discharge head according to an eighth embodiment of the present invention.
Figure 14:
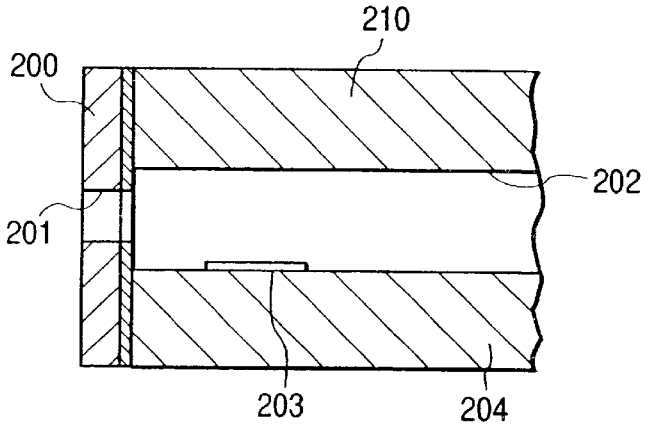
FIG. 14 PRIOR ART
FIG. 14 is a typical cross-sectional view showing an example of the liquid discharge head according to the prior art.
Figure 15:
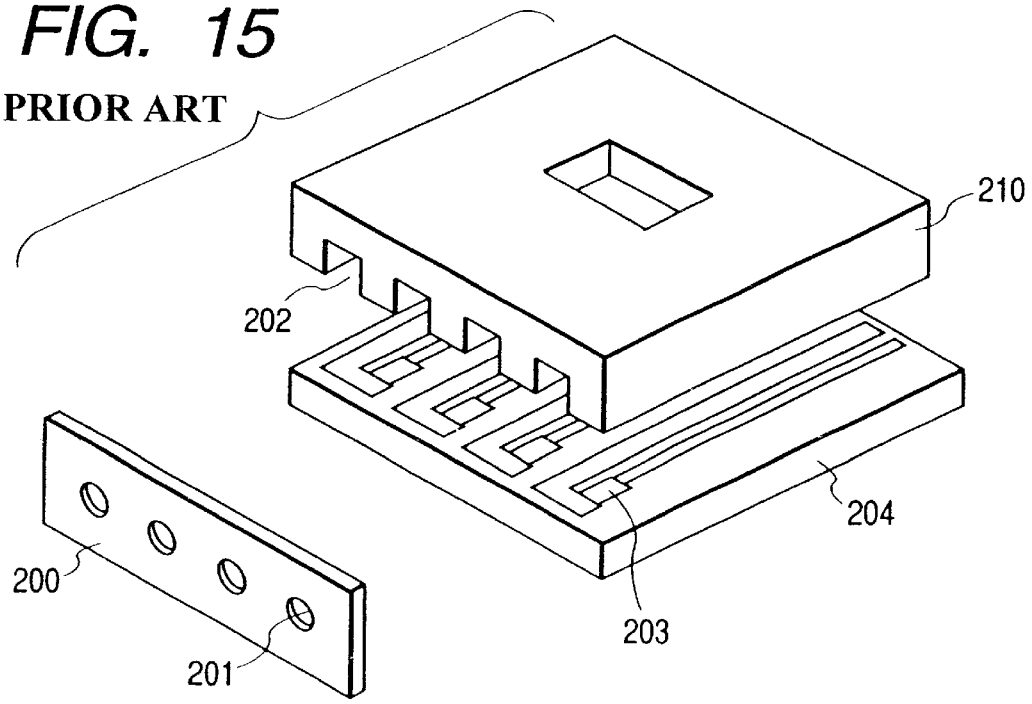
FIG. 15 PRIOR ART
FIG. 15 is an exploded perspective view showing an example of the liquid discharge head according to the prior art.

In the fifth embodiment, the wall-shaped convex portions have their opposite end portions formed into a tapered shape so as to be lengthwisely tapered, but in an eighth embodiment shown in FIG. 13, wall-shaped convex portions 645 have their outer sides 645*a* formed into a tapered shape so as to be widthwisely tapered. Again in this case, the work of bringing the convex portions 645 into the communication ports of the flow paths 401 can be done easily. Of course, it will be more effective if the wall-shaped convex portions 645 are formed into a tapered shape so as to be tapered both lengthwisely and widthwisely.

It is also possible to adopt constructions in which the constructions of the first to eighth embodiments described above are variously combined.

What is claimed is:

1. A liquid discharge head having:

an orifice plate in which a plurality of discharge ports for discharging liquid droplets there through are arranged in a row; and a head body provided with a plurality of flow paths communicating with said plurality of discharge ports, a liquid chamber for supplying liquid to said plurality of flow paths, and a plurality of energy generation elements disposed correspondingly to said plurality of flow paths and generating energy for discharging the liquid droplets, wherein said orifice plate is joined to the surface of said head body in which the communication ports of said flow paths communicating with said discharge ports are disposed;

wherein said orifice plate is formed with wall-shaped convex portions protruding from the inner peripheral portions of said discharge ports and having at least a portion entering from said communication ports into said flow paths, and the width of said wall-shaped convex portions is greater in the portions parallel to the row direction in which said plurality of discharge ports are arranged than in the portions orthogonal to said row direction.

2. A liquid discharge head according to claim 1, wherein said wall-shaped convex portions are provided along the entire inner peripheral portions of said discharge ports.

3. A liquid discharge head according to claim 1, wherein said orifice plate is formed of resin, silicon, ceramics or a metal material.

4. A liquid discharge head according to claim 1, wherein said discharge ports are of a tapered shape.

5. A liquid discharge head according to claim 1, wherein said orifice plate is joined to said head body by an adhesive layer, and said adhesive layer comprises an adhesive made into B stage by carrying out processing including the application of ultraviolet rays, infrared rays or heat.

6. A liquid discharge head according to claim 5, wherein said adhesive layer comprises an epoxy adhesive, said epoxy adhesive having a thermosetting property and/or a light energy hardening property.

7. A liquid discharge head having:

an orifice plate in which a plurality of discharge ports for discharging liquid droplets there through are arranged in a row; and a head body provided with a plurality of flow paths communicating with said plurality of discharge ports, a liquid chamber for supplying liquid to said plurality of flow paths, and a plurality of energy generation elements disposed correspondingly to said plurality of flow paths and generating energy for discharging the liquid droplets, wherein said orifice plate is joined to the surface of said head body in which the communication ports of said flow paths communicating with said discharge ports are disposed;

wherein said orifice plate is formed with wall-shaped convex portions protruding from the inner peripheral portions of said discharge ports and having at least a portion entering from said communication ports into said flow paths, and on the surface side of said orifice plate to said head body, as compared with the inner end portions of said discharge ports at positions orthogonal to the row direction in which said plurality of discharge ports are arranged, said wall-shaped convex portions located in parallel to said row direction are formed high in the direction of thickness of said orifice plate.

8. A liquid discharge head according to claim 7, wherein said wall-shaped convex portions include portions parallel to said row direction and portions orthogonal to said row direction, and the inner end portions of said discharge ports at the positions orthogonal to said row direction are the fore end portions of those portions of said wall-shaped convex portions which are orthogonal to said row direction.

9. A liquid discharge head according to claim 7, wherein said wall-shaped convex portions are provided in only the portions parallel to said row direction.

10. A liquid discharge head according to claim 7, wherein at least a portion of the inner sides of said wall-shaped convex portions is a curved surface.

11. A liquid discharge head according to claim 10, wherein said curved surface is of a shape substantially similar to the shape of said discharge ports.

12. A liquid discharge head according to claim 7, wherein interruption wall portions substantially parallel to said row direction are provided outside the portions of said wall-shaped convex portions which are parallel to said row direction.

13. A liquid discharge head according to claim 7, wherein groove portions substantially parallel to said row direction are provided outside the portions of said wall-shaped convex portions which are parallel to said row direction.

14. A liquid discharge head according to claim 7, wherein interruption wall portions substantially parallel to said row direction and groove portions substantially parallel to said row direction are provided outside the portions of said wall-shaped convex portions which are parallel to said row direction.

15. A liquid discharge head according to claim 3, wherein an interruption wall portion substantially orthogonal to said row direction, which is collapsed and deformed during the joining of said orifice plate and said head body, is provided between adjacent ones of said discharge ports.

16. A liquid discharge head according to claim 7, wherein a groove portion substantially orthogonal to said row direction is provided between adjacent ones of said discharge ports.

17. A liquid discharge head according to claim 7, wherein said orifice plate is formed of resin, silicon, ceramics or a metal material.

18. A liquid discharge head according to claim 7, wherein said discharge ports are of a tapered shape.

19. A liquid discharge head according to claim 7, wherein said orifice plate is joined to said head body by an adhesive layer, and said adhesive layer comprises an adhesive made into B stage by carrying out processing including the application of ultraviolet rays, infrared rays or heat.

20. A liquid discharge head according to claim 19, wherein said adhesive layer comprises an epoxy adhesive, said epoxy adhesive having a thermosetting property and/or a light energy hardening property.

21. A method of manufacturing a liquid discharge head, comprising the following steps:

discharging liquid droplets through a plurality of discharge ports, the plurality of discharge ports being arranged in a row on an orifice plate, communicating the plurality of flow paths with the plurality of discharge ports, supplying liquid to the plurality of flow paths, and generating energy for discharging the liquid droplets, the energy being generated by a plurality of energy generation elements disposed correspondingly to the plurality of flow paths and generating energy for discharging the liquid droplets, joining the orifice plate to the surface of the head body, the head body being disposed with the communication ports of the flow paths for communicating with the discharge ports, forming the orifice plate with wall-shaped convex portions protruding from the inner peripheral portions of the discharge ports, the discharge ports having at least a portion entering from the communication ports into the flow paths, and after the discharge ports have been formed by laser working, forming wall-shaped convex portions by laser working, wherein the wall-shaped convex portions are formed high in the direction of thickness of the plate, as compared with the inner end portions of the discharge ports at positions orthogonal to the row direction in which the plurality of discharge ports are arranged.

22. A method of manufacturing a liquid discharge head according to claim 21, wherein the laser working is laser ablation working by an excimer laser.

23. A method of manufacturing a liquid discharge head according to claim 21, wherein the orifice plate is formed of one of polysulfone, polyether sulfone, polyphenylene sulfide and polyether ether ketone.

24. A method of manufacturing a liquid discharge head according to claim 21, wherein the discharge ports are of a tapered shape.

25. A method of manufacturing a liquid discharge head, comprising the following steps:

discharging liquid droplets through a plurality of discharge ports, the plurality of discharge ports being arranged in a row on an orifice plate, communicating the plurality of flow paths with the plurality of discharge ports, supplying liquid to the plurality of flow paths, and generating energy for discharging the liquid droplets, the energy being generated by a plurality of energy generation elements disposed correspondingly to the plurality of flow paths and generating energy for discharging the liquid droplets, joining the orifice plate to the surface of the head body, the head body being disposed with the communication ports of the flow paths for communicating with the discharge ports, forming the orifice plate with wall-shaped convex portions protruding from the inner peripheral portions of the discharge ports, the discharge ports having at least a portion entering from the communication ports into the flow paths, and after the discharge ports have been formed by laser working, forming wall-shaped convex portions by laser working, wherein the wall-shaped convex portions are provided in only the portions parallel to the row direction.

26. A method of manufacturing a liquid discharge head according to claim 25, wherein the laser working is laser ablation working by an excimer laser.

27. A method of manufacturing a liquid discharge head according to claim 25, wherein the orifice plate is formed of one of polysulfone, polyether sulfone, polyphenylene sulfide and polyether ether ketone.

28. A method of manufacturing a liquid discharge head according to claim 25, wherein the discharge ports are of a tapered shape.

* * * * *

UNITED STATES PATENT AND TRADEMARK OFFICE

CERTIFICATE OF CORRECTION

PATENT NO. : 6,422,686 B1
DATED : July 23, 2002
INVENTOR(S) : Ishinaga et al.

It is certified that error appears in the above-identified patent and that said Letters Patent is hereby corrected as shown below:

Column 1,
Line 26, “is” should read -- as --.

Column 3,
Line 7, “ports-of” should read -- ports of --.

Column 4,
Line 10, “Silicon” should read -- silicon --.

Column 12,
Line 11, “into” (first occurrence) should read -- of --;
Line 25, “abut-against” should read -- abut against --; and
Line 62, “there through” should read -- therethrough --.

Column 13,
Line 35, “there through” should read -- therethrough --.

Column 14,
Line 23, “claim 3” should read -- claim 7 --.

Signed and Sealed this

Twenty-ninth Day of April, 2003

JAMES E. ROGAN
*Director of the United States Patent and Trademark Office*